US010501227B2

(12) United States Patent
Fitzwater et al.

(10) Patent No.: US 10,501,227 B2
(45) Date of Patent: Dec. 10, 2019

(54) CARTON WITH RECLOSABLE LID

(71) Applicant: Graphic Packaging International, Inc., Atlanta, GA (US)

(72) Inventors: Kelly R. Fitzwater, Lakewood, CO (US); Weston R. Wilson, Arvada, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 253 days.

(21) Appl. No.: 15/617,064

(22) Filed: Jun. 8, 2017

(65) Prior Publication Data

US 2017/0267400 A1 Sep. 21, 2017

Related U.S. Application Data

(62) Division of application No. 13/298,603, filed on Nov. 17, 2011, now Pat. No. 9,701,438.

(60) Provisional application No. 61/458,105, filed on Nov. 17, 2010.

(51) Int. Cl.
*B65D 5/66* (2006.01)

(52) U.S. Cl.
CPC ..... *B65D 5/6623* (2013.01)

(58) Field of Classification Search
CPC ..... B31B 50/48; B31B 50/682; B31B 50/732; B31B 50/724; B31B 50/814; B31B 50/84; B31B 50/85
USPC ..... 493/70, 87, 102, 114, 115, 139
See application file for complete search history.

(56) References Cited

U.S. PATENT DOCUMENTS

| | | | |
|---|---|---|---|
| 1,772,625 | A | 8/1930 | Caulfield |
| 2,192,722 | A | 3/1940 | Vogt |
| 2,355,665 | A | 8/1944 | Mabee |
| 2,475,677 | A | 7/1949 | Ringler |
| 2,509,289 | A | 5/1950 | Dunning |
| 3,105,591 | A | 10/1963 | Ahlbor |

(Continued)

FOREIGN PATENT DOCUMENTS

| | | |
|---|---|---|
| DE | 29 23 455 A1 | 12/1980 |
| DE | 81 10 323.9 | 9/1981 |

(Continued)

OTHER PUBLICATIONS

International Search Report and Written Opinion for PCT/US2011/061148 dated May 7, 2012.

(Continued)

*Primary Examiner* — Robert F Long
*Assistant Examiner* — Christopher Robin Kim
(74) *Attorney, Agent, or Firm* — Womble Bond Dickinson (US) LLP

(57) ABSTRACT

A carton for containing a product. The carton can comprise a plurality of panels that extends at least partially around an interior of the carton. The plurality of panels comprises a first end panel, a first side panel, a second end panel, and a second side panel. At least one top flap is respectively foldably connected to a respective panel of the plurality of panels. The at least one top flap at least partially forms a closed top end of the carton. A reclosable lid is positionable between an open position and a closed position. The reclosable lid comprises a central panel that is foldably connected to the at least one top flap. The reclosable lid can be downwardly folded relative to the at least one top flap in the closed position.

9 Claims, 5 Drawing Sheets

(56) References Cited

U.S. PATENT DOCUMENTS

| | | | | |
|---|---|---|---|---|
| 3,133,688 | A * | 5/1964 | Asman | B65D 5/703 229/215 |
| 3,233,817 | A | 2/1966 | Casady | |
| 3,302,847 | A | 2/1967 | Hennessey | |
| 3,347,446 | A | 10/1967 | Reynolds et al. | |
| 3,355,089 | A | 11/1967 | Champlin | |
| 3,363,822 | A | 1/1968 | Maulini et al. | |
| 3,426,955 | A | 2/1969 | Olson | |
| 3,426,956 | A * | 2/1969 | Frohlicher | B65D 5/701 229/231 |
| 3,669,345 | A | 6/1972 | Cote | |
| 3,680,766 | A | 8/1972 | Collura et al. | |
| 3,690,544 | A | 9/1972 | Myers | |
| 3,768,719 | A | 10/1973 | Johnson | |
| 3,982,683 | A | 9/1976 | Forteau | |
| 4,344,537 | A | 8/1982 | Austin | |
| 4,508,218 | A | 4/1985 | Focke | |
| 4,558,785 | A | 12/1985 | Gordon | |
| 4,572,422 | A | 2/1986 | Heuberger et al. | |
| 4,645,108 | A | 2/1987 | Gavin | |
| 4,676,394 | A | 6/1987 | Hiersteiner | |
| 4,768,703 | A | 9/1988 | Sosler | |
| 4,771,936 | A | 9/1988 | Dolby | |
| 4,802,608 | A * | 2/1989 | Hofmann | A47G 19/24 220/259.2 |
| 4,905,898 | A | 3/1990 | Wade | |
| 5,125,566 | A | 6/1992 | Deiger | |
| 5,201,462 | A | 4/1993 | Sada et al. | |
| 5,292,058 | A | 3/1994 | Zoss | |
| 5,347,865 | A | 9/1994 | Mulry | |
| 5,402,933 | A | 4/1995 | Behrmann | |
| 5,632,402 | A | 5/1997 | Walsh | |
| 5,632,404 | A | 5/1997 | Walsh | |
| 5,746,871 | A | 5/1998 | Walsh | |
| 5,783,030 | A | 7/1998 | Walsh | |
| 5,794,811 | A | 8/1998 | Walsh | |
| 5,794,812 | A | 8/1998 | Walsh | |
| 5,857,614 | A | 1/1999 | Walsh | |
| 5,911,359 | A | 6/1999 | Stone | |
| 5,918,799 | A | 7/1999 | Walsh | |
| 6,050,484 | A | 4/2000 | Galomb | |
| 6,062,467 | A | 5/2000 | Ours | |
| 6,102,277 | A | 8/2000 | Krapohl, Sr. | |
| 6,145,736 | A | 11/2000 | Ours | |
| 6,206,279 | B1 | 3/2001 | Countee | |
| 6,352,096 | B1 | 3/2002 | Walsh | |
| 6,364,202 | B1 | 4/2002 | Zelley | |
| 6,386,438 | B1 | 5/2002 | Walsh et al. | |
| 6,419,151 | B1 * | 7/2002 | Urtubey | B65D 5/745 229/125.42 |
| 6,688,515 | B1 | 2/2004 | Huffman et al. | |
| 6,854,639 | B2 | 2/2005 | Walsh | |
| 6,869,009 | B2 | 3/2005 | Sutherland | |
| 6,913,190 | B2 | 7/2005 | Ruhbusch | |
| 7,025,504 | B2 | 4/2006 | Olin | |
| 7,036,714 | B2 | 5/2006 | Walsh | |
| 7,210,612 | B2 | 5/2007 | Walsh | |
| 7,306,135 | B2 | 12/2007 | DeBusk | |
| 7,407,087 | B2 | 8/2008 | DeBusk | |
| 7,503,475 | B2 | 3/2009 | McGowan | |
| D597,835 | S * | 8/2009 | Kwon | D9/432 |
| 7,703,665 | B2 | 4/2010 | McGowan | |
| 7,913,897 | B2 | 3/2011 | Manaige | |
| 7,959,060 | B2 | 6/2011 | Wilson | |
| 8,002,171 | B2 | 8/2011 | Ryan | |
| 8,061,585 | B2 | 11/2011 | Nikolai | |
| 9,108,761 | B2 * | 8/2015 | Fitzwater | B65D 5/563 |
| 9,156,582 | B2 * | 10/2015 | Walsh | B65D 5/701 |
| 10,124,947 | B2 * | 11/2018 | Pinkstone | B65D 5/742 |
| 2001/0048022 | A1 | 12/2001 | Zoeckler | |
| 2002/0055429 | A1 | 5/2002 | Walsh | |
| 2003/0144121 | A1 | 7/2003 | Walsh | |
| 2004/0226989 | A1 | 11/2004 | Cook | |
| 2005/0127150 | A1 | 6/2005 | Walsh | |
| 2005/0187087 | A1 | 8/2005 | Walsh | |
| 2005/0211754 | A1 | 9/2005 | Fulcher | |
| 2005/0274782 | A1 | 12/2005 | Petrelli | |
| 2006/0054675 | A1 | 3/2006 | Bennett | |
| 2006/0243783 | A1 | 11/2006 | Spivey | |
| 2007/0235511 | A1 | 10/2007 | Fitzwater | |
| 2009/0045084 | A1 | 2/2009 | Roila et al. | |
| 2010/0193575 | A1 | 8/2010 | Fontaine | |

FOREIGN PATENT DOCUMENTS

| | | | | |
|---|---|---|---|---|
| DE | 87 08 078.8 | | 10/1987 | |
| DE | 94 13 813 | U1 | 10/1994 | |
| EP | 0 406 556 | A1 | 1/1999 | |
| EP | 1 386 846 | A1 | 2/2004 | |
| EP | 1386846 | A1 * | 2/2004 | B65D 5/544 |
| EP | 1 457 425 | A1 | 9/2004 | |
| FR | 2 699 150 | | 6/1994 | |
| FR | 2 755 670 | | 5/1998 | |
| GB | 104445 | | 3/1917 | |
| GB | 1 242 356 | | 8/1971 | |
| GB | 1 489 963 | | 10/1977 | |
| GB | 1 584 066 | | 2/1981 | |
| GB | 2 363 372 | A | 12/2001 | |
| JP | 50-123654 | | 10/1975 | |
| JP | 05-310266 | | 11/1993 | |
| WO | WO 95/28325 | | 10/1995 | |
| WO | WO 2006/124643 | A1 | 11/2006 | |
| WO | WO 2006/133401 | A2 | 12/2006 | |

OTHER PUBLICATIONS

International Search Report and Written Opinion for PCT/US2012/022458 dated Aug. 7, 2012.
Office Action for U.S. Appl. No. 13/298,603 dated Mar. 19, 2013.
Response to Restriction Requirement for U.S. Appl. No. 13/298,603 dated Mar. 21, 2013.
Office Action for U.S. Appl. No. 13/298,603 dated Oct. 23, 2013.
Amendment a and Response to Office Action for U.S. Appl. No. 13/298,603 dated Jan. 23, 2014.
Office Action for U.S. Appl. No. 13/298,603 dated Apr. 24, 2014.
Notice of Appeal for U.S. Appl. No. 13/298,603 dated Jul. 24, 2014.
Appeal Brief for U.S. Appl. No. 13/298,603 dated Sep. 24, 2014.
Office Action for U.S. Appl. No. 13/298,603 dated Feb. 27, 2015.
Amendment B and Response to Office Action for U.S. Appl. No. 13/298,603 dated May 27, 2015.
Office Action for U.S. Appl. No. 13/298,603 dated Aug. 26, 2015.
Request for Continued Examination (RCE) Transmittal for U.S. Appl. No. 13/298,603 dated Dec. 28, 2015.
Amendment C and Response to Final Office Action for U.S. Appl. No. 13/298,603 dated Dec. 28, 2015.
Office Action for U.S. Appl. No. 13/298,603 dated Oct. 27, 2016.
Amendment D and Response to Office Action for U.S. Appl. No. 13/298,603 dated Feb. 27, 2017.
Notice of Allowance and Fee(s) Due for U.S. Appl. No. 13/298,603 dated Mar. 20, 2017.
Issue Fee Transmittal Form for U.S. Appl. No. 13/298,603 dated Jun. 8, 2017.
Issue Notification for U.S. Appl. No. 13/298,603 dated Jun. 21, 2017.

* cited by examiner

CARTON WITH RECLOSABLE LID

CROSS-REFERENCE TO RELATED APPLICATIONS

This application is a divisional application of U.S. patent application Ser. No. 13/298,603, filed Nov. 17, 2011, which claims the benefit of U.S. Provisional Patent Application No. 61/458,105, filed Nov. 17, 2010.

INCORPORATION BY REFERENCE

The disclosures of U.S. patent application Ser. No. 13/298,603, which was filed on Nov. 17, 2011, and U.S. Provisional Patent Application No. 61/458,105, which was filed on Nov. 17, 2010, are hereby incorporated by reference for all purposes as if presented herein in their entirety.

BACKGROUND OF THE DISCLOSURE

The present disclosure generally relates to cartons having a reclosable lid.

SUMMARY OF THE DISCLOSURE

In general, one aspect of the disclosure is directed to a carton for containing a product.

The carton can comprise a plurality of panels that extends at least partially around an interior of the carton. The plurality of panels comprises a first end panel, a first side panel, a second end panel, and a second side panel. At least one top flap is respectively foldably connected to a respective panel of the plurality of panels. The at least one top flap at least partially forms a closed top end of the carton. A reclosable lid is positionable between an open position and a closed position. The reclosable lid comprises a central panel that is foldably connected to the at least one top flap. The reclosable lid can be downwardly folded relative to the at least one top flap in the closed position.

In another aspect, the disclosure is generally directed to a blank for forming a carton.

The blank can comprise a plurality of panels comprising a first end panel, a first side panel, a second end panel, and a second side panel. At least one of the first side panel and the second side panel has an oblique edge. At least one top flap is respectively foldably connected to a respective panel of the plurality of panels. The at least one top flap is for at least partially forming a closed top end of the carton formed from the blank. The blank further can comprise lid features for forming a reclosable lid positionable between an open position and a closed position in the carton formed from the blank. The lid features comprise a central panel that is foldably connected to the at least one top flap, and the lid features are adjacent to the oblique edge.

In another aspect, the disclosure is generally directed to a method of assembling a carton. The method can comprise obtaining a blank comprising a plurality of panels comprising a first end panel, a first side panel, a second end panel, and a second side panel, at least one top flap respectively foldably connected to a respective panel of the plurality of panels, and lid features comprising a central panel. The central panel can be foldably connected to the at least one top flap. The method further can comprise forming an interior of the carton at least partially defined by the plurality of panels. The forming the interior of the carton comprises forming an open-ended sleeve. The method further can comprise positioning the at least one top flap to at least partially close a top end of the open-ended sleeve, positioning the lid features to form a reclosable lid, and positioning the reclosable lid to a closed position wherein the reclosable lid is downwardly folded relative to the at least one top flap.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a reclosable carton with a foldably connected lid. The carton can include a flexible vessel such as a bag in the carton interior. The flexible vessel can be used to store product (e.g., flowable materials) in the carton. Flowable materials can include, but are not limited to, particulates, granular materials, powders, liquids, and the like, or any combination thereof. Alternatively, other products can be stored in the flexible vessel or carton, or the product can be omitted. The flexible vessel can be made from materials suitable in composition for packaging the particular product, and the materials include, but are not limited to, plastics such as PET, LDPE, LLDPE, HDPE, PP, PS, PVC, EVOH, and Nylon; and the like, or any combination thereof. Alternatively, the flexible vessel could be omitted or could be a liner or coating applied to the interior surface of the carton.

Cartons according to the present disclosure can accommodate flexible vessels of any shape. For the purpose of illustration and not for the purpose of limiting the scope of the disclosure, the following detailed description describes a bag as disposed within the carton embodiments. In this specification, the terms "lower," "bottom," "upper," and "top" indicate orientations determined in relation to fully erected and upright cartons.

Figure 1:
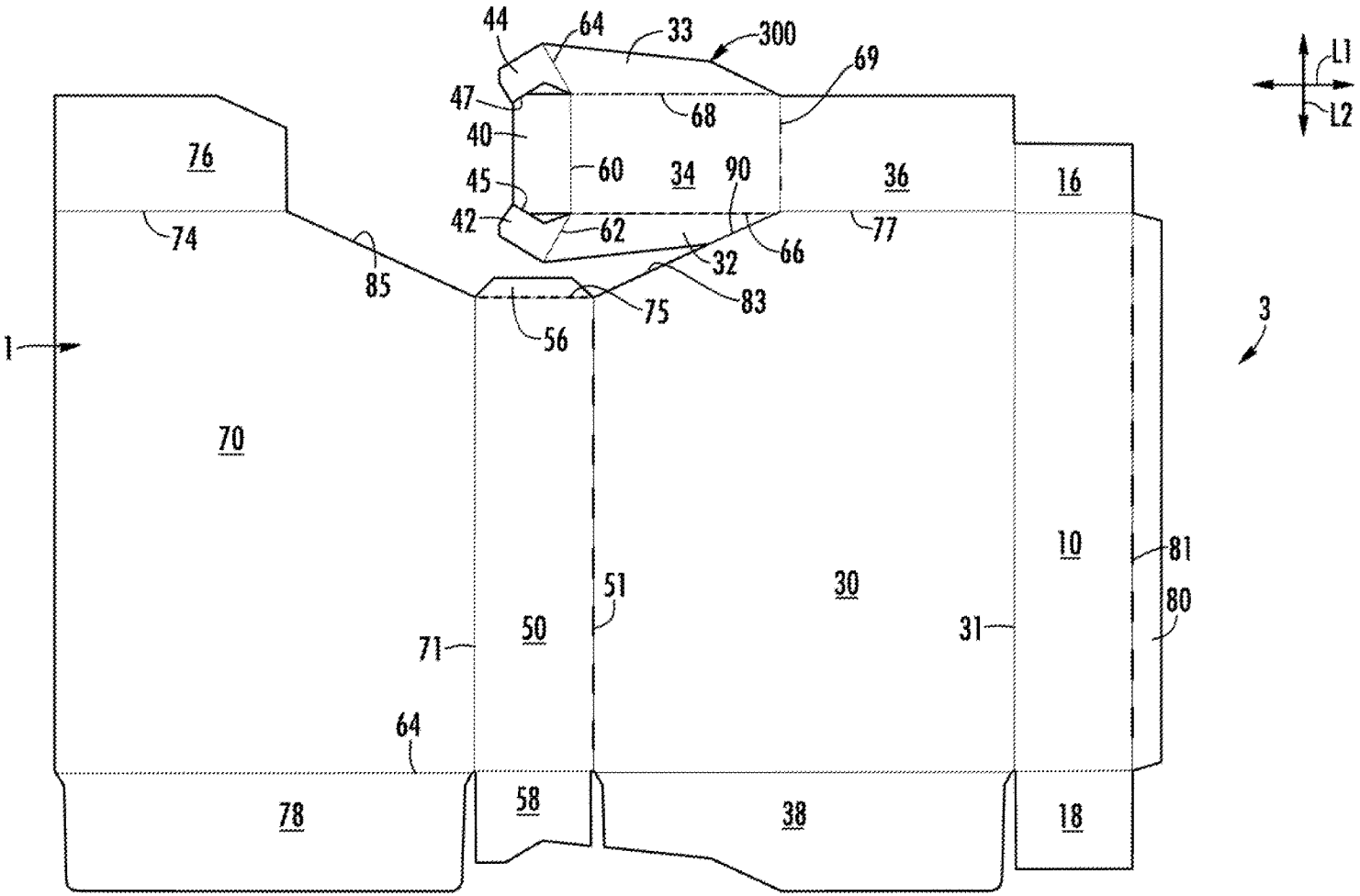
FIG. 1 is an exterior plan view of a carton blank used to form a carton in accordance with an embodiment of the disclosure.
Figure 4:
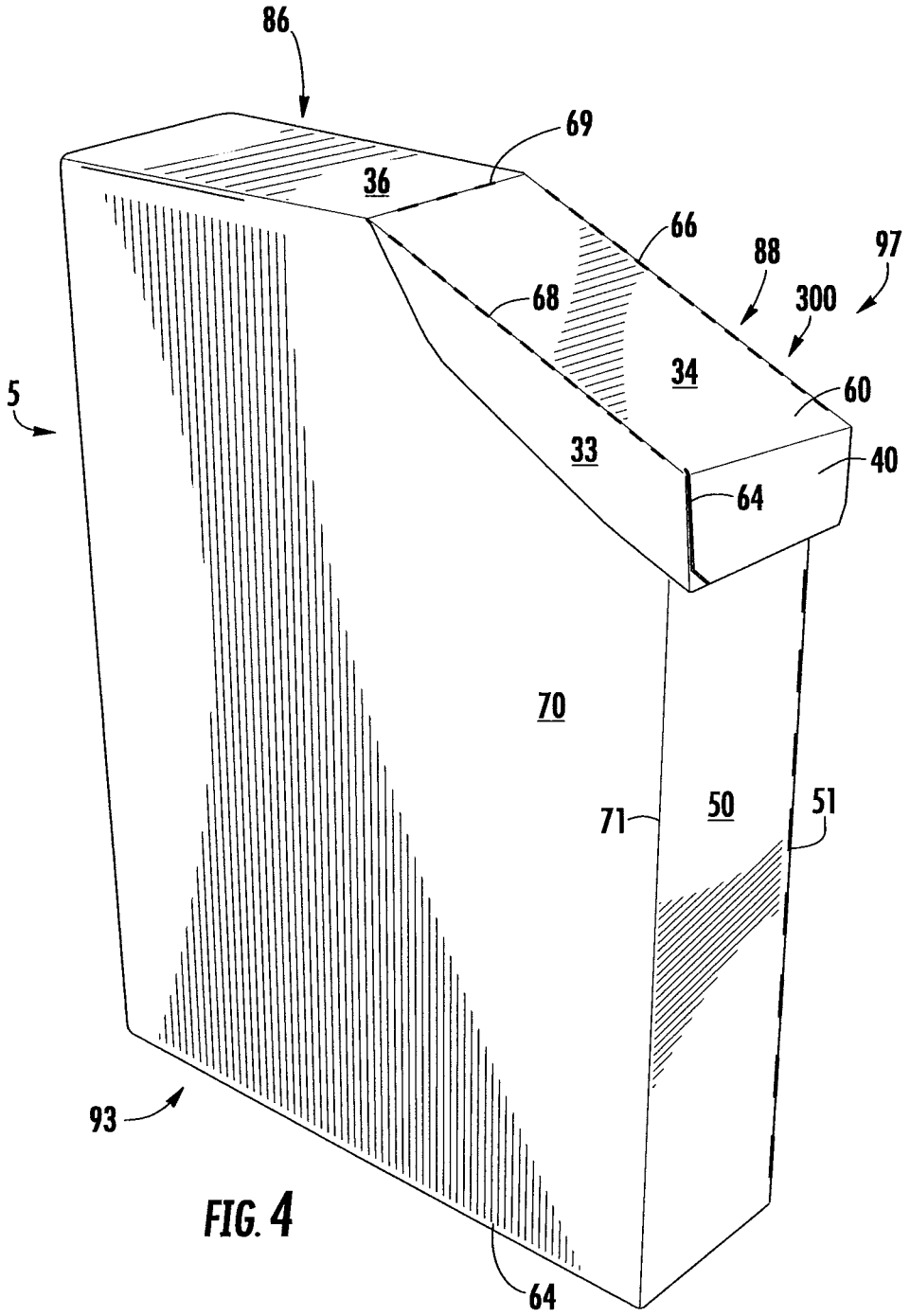
FIG. 4 is a perspective view of the assembled carton in accordance with the embodiment of the disclosure.
Figure 5:
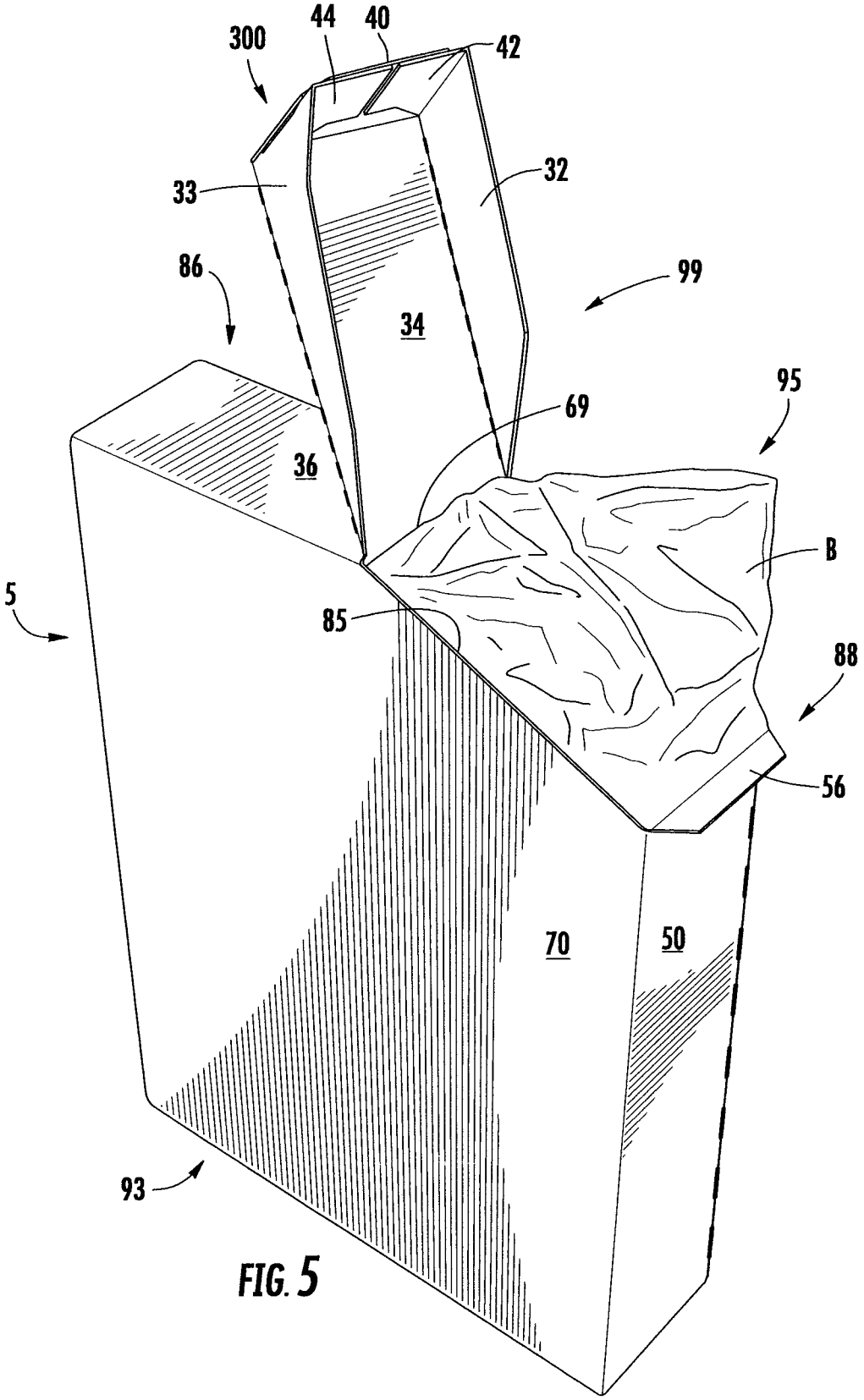
FIG. 5 is a perspective view of the assembled carton of FIG. 4 with a reclosable lid in an open position in accordance with the embodiment of the disclosure.

FIG. 1 is a plan view of a first, exterior side 1 of a blank 3 used to form a carton 5 (illustrated in FIG. 4) having a reclosable lid 300 according to the exemplary embodiment of the disclosure. The reclosable lid 300 can be configured to selectively open and at least partially close a front top portion 88 of the carton 5 (FIGS. 4 and 5). A bag B or other flexible vessel optionally can be enclosed in the carton 5 (FIG. 2) for holding a product within the carton 5. In one embodiment, the carton 5 and the bag B can be sized and shaped to hold approximately 2 liters of product, for example, but it is understood that the carton 5 may be sized and shaped to hold contents of a different quantity.

The blank 3 has a longitudinal axis L1 and a lateral axis L2. In the illustrated embodiment, the blank 3 comprises a first end panel 10 foldably connected to a first side panel 30 at a first lateral fold line 31, a second end panel 50 foldably connected to the first side panel 30 at a second lateral fold line 51, and a second side panel 70 foldably connected to the second end panel 50 at a third lateral fold line 71. In the illustrated embodiment, an attachment flap 80 is foldably connected to the first end panel 10 at a fourth lateral fold line 81. Alternatively, the attachment flap 80 could be foldably connected to the second side panel 70 or omitted without departing from the scope of the disclosure.

The first end panel 10 is foldably connected to a first end top flap 16 and a first end bottom flap 18. The first side panel 30 is foldably connected to a first side top flap 36 and a first side bottom flap 38. The second end panel 50 is foldably connected to a top end locking tab or flap 56 and a second end bottom flap 58. The second side panel 70 is foldably connected to a second side top flap 76 and a second side bottom flap 78. The top flaps 16, 36, 76 extend along a first or top marginal area of the blank 3. The first end top flap 16 is foldably connected to the first end panel 10 and the first side top flap 36 is foldably connected to the first side panel 30 along a first longitudinal fold line 77. The top end locking tab 56 is foldably connected to the second end panel 50 at a second longitudinal fold line 75. The side top flap 76 is foldably connected to the second side panel 70 at a third longitudinal fold line 74. The bottom flaps 18, 38, 58, 78 extend along a second or bottom marginal area of the blank 8, and may be foldably connected along a fourth longitudinal fold line 64 that extends along the length of the blank.

In one embodiment, the first, second, third, and fourth longitudinal fold lines 77, 75, 74, 64 may be, for example, generally straight lines of disruption, or the fold lines 77, 75, 74, 64 may be offset at one or more locations to account for, for example, blank thickness or other factors. When the carton 5 (FIG. 4) is erected, the top flaps 16, 36, 76 close a first (e.g., top) end 86 of the carton 5, and the bottom flaps 18, 38, 58, 78 close a bottom end 93 of the carton 5.

In the illustrated embodiment the first side panel 30 has an oblique edge 83 and the second side panel 70 has an oblique edge 85. The oblique edge 83 can extend between respective ends of the fold lines 77, 75. The oblique edge 85 can extend between respective ends of the fold lines 74, 75. In the illustrated embodiment, the oblique edges 83, 85 are free from connection to any end flap or panel, but one or both of the oblique edges could be connected to an end flap or panel without departing from the scope of the disclosure. The oblique edges 83, 85 can at least partially form the front top portion 88 of the carton 5.

As shown in FIG. 1, a reclosable lid 300 is foldably connected to the first side top flap 36 at a lateral fold line 69. The reclosable lid 300 includes a central panel 34, first lid flap 32, a second lid flap 33, and a third lid flap 40. As shown in FIG. 1, the central panel 34, which is part of the reclosable lid 300, is directly foldably connected to the first side top flap 36, which is part of the closed top end 86, along the fold line 69. The lid flaps 32, 33 are respectively foldably connected to the central panel 34 along longitudinally-extending fold lines 66, 68, and the third lid flap 40 is foldably connected to the central panel 34 along a lateral fold line 60. In the illustrated embodiment, a portion of the first lid flap 32 can be separable from the first side panel along an oblique cut line 90. As shown in FIG. 1, the first and second lid flaps 32, 33 are foldably connected to respective closure tabs 42, 44 along respective oblique fold lines 62, 64. In one embodiment, the closure tabs 42, 44 can be angled toward the third lid flap 40 and separable from the third lid flap 40 along respective cut lines 45, 47. The central panel 34, the lid flaps 32, 33, 40, and the closure tabs 42, 44 at least partially define the reclosable lid 300 in the erected carton 5 (FIGS. 4 and 5). The reclosable lid 300 could be omitted or otherwise shaped, arranged, and/or configured without departing from the disclosure.

According to one exemplary method of construction, the carton 5 may be erected by folding the blank 3 about the lateral fold lines 81, 51 so that the exterior side of the attachment flap 80 contacts the interior side of the second side panel 70. The second side panel 70 can be adhered to the attachment flap 80 by, for example, glue, adhesives, or other means. The blank 3 may then be opened to have a generally tubular shape by folding about fold lines 31, 51, 71, 81.

In the illustrated embodiment, the bottom end 93 of the partially erected carton 5 can be closed by respectively overlapping and adhering the first and second end bottom flaps 18, 58 and the first and second side bottom flaps 38, 78. For example, in one embodiment, the bottom end 93 of the partially erected carton 5 can be closed by folding the first and second end bottom flaps 18, 58 inwardly, followed by folding the first and second side bottom flaps 38, 78. The interior surface of the second side bottom flap 78 can be adhered to the exterior side of the first side bottom flap 38. Portions of one or both of the first and second side bottom flaps 38, 78 may also be adhered to the first and second end bottom flaps 18, 58 without departing from the disclosure.

Figure 2:
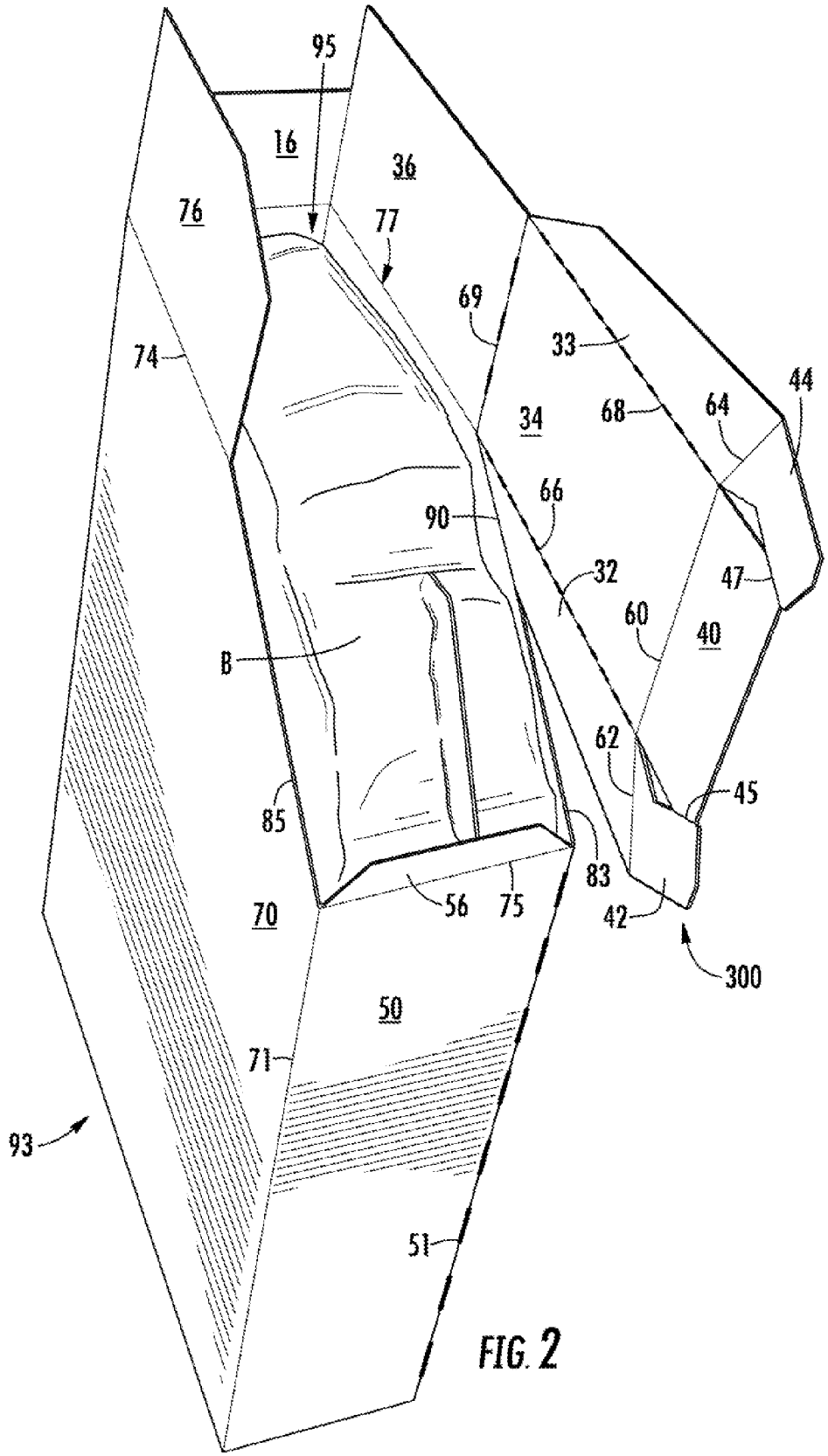
FIG. 2 is a perspective view of the carton in a partially assembled configuration in accordance with the embodiment of the disclosure.

Products such as food products (not shown) may be placed in the interior space 95 of the partially formed carton 5. As shown in FIG. 2, a bag B or other flexible vessel can be inserted into the interior 95 of the carton 5, and products can be loaded into the bag B. Optionally, the bag can be sealed closed in the interior 95 of the carton 5. Alternatively, the products can be otherwise loaded into the carton 5 and/or bag B, and/or the products can be omitted without departing from the disclosure. For example, the products can be placed in the bag B or other flexible vessel, and the bag can be placed in the interior space of the partially formed carton.

Figure 3:
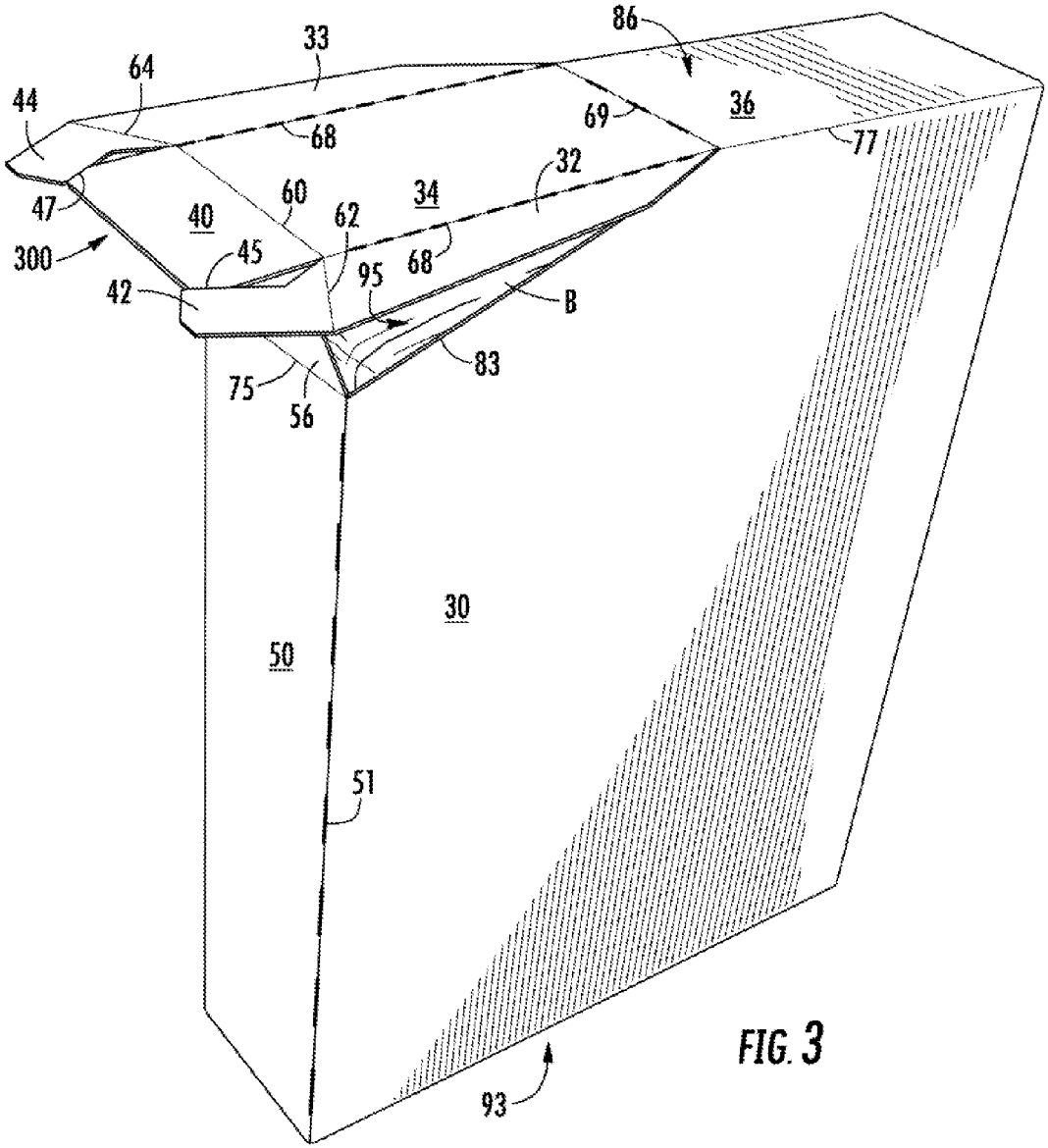
FIG. 3 is a perspective view of the carton in a further assembled configuration in accordance with the embodiment of the disclosure.

As shown in FIG. 3, the top end 86 of the partially formed carton 5 can be closed by folding and at least partially overlapping and adhering the top flaps 16, 36, 76. The top end 86 and the bottom end 93 can be alternatively closed without departing from the disclosure.

In the illustrated embodiment, the reclosable lid 300 is configured to close the front top portion 88 of the carton 5. As shown in FIG. 4, the reclosable lid is formed by folding the lid flaps 32, 33, 40 downwardly relative to the central panel 34 along respective fold lines 66, 68, 60, and the closure tabs 42, 44 are inwardly folded to overlap the interior surface of the third lid flap 40. The closure tabs 42, 44 can be adhesively secured to the third lip flap 40. The top end locking tab 56 can be downwardly folded about fold line 75 toward the exterior surface of the second end panel 50 (FIG. 5). The reclosable lid 300 is downwardly folded about fold line 69 so that the central panel is disposed adjacent to or abuts the oblique edges 83, 85 of the respective first and second side panels 30, 70. As shown in FIG. 4, the first and second lid flaps 32, 33 extend downwardly below the respective oblique edges 83, 85 and the third lid flap 40 extends downwardly below the fold line 75 when the reclosable lid 300 is in a closed position 97. Accordingly, the first and second lid flaps 32, 33 can extend adjacent and generally parallel to, and/or be in face-to-face contact with, portions of the respective side panels 30, 70. The third lid flap 40 and the closure tabs 42, 44 can extend adjacent and generally parallel to, and/or be in face-to-face contact with, a portion of the second end panel 50, and the top end locking tab 56 can contact or engage at least one of the closure tabs 42, 44 and the third lid flap 40. Since the fold lines 62, 64 are oblique with respect to the longitudinal direction L1 and the lateral direction L2 in the blank 3, the closure tabs 42, 44 can be adhered to the third lid flap 40 so that the lid flaps 32, 33, 40 and the closure tabs 42, 44 are generally vertical in the blank 5, while the central panel 34 is generally oblique with respect to at least the first side top flap 36 and the second end panel 50.

Accordingly, the reclosable lid 300 closes the front top portion 88 of the carton 5. The top end locking tab 56 can be temporarily adhered to an inner surface of the reclosable lid 300 (e.g., interior surface of the third lid flap 40 and/or the closure tabs 42, 44) with a temporary or resealable adhesive. Alternatively, or in addition, one or more portions of the reclosable lid 300 can be releasably adhered to the first side panel 30, the second side panel 70, the second end panel 50, or combinations thereof. In one embodiment, the retention tab 56 and the reclosable lid 300 can have latching features that retain the lid in the closed position.

FIG. 4 illustrates the erected carton 5, which is substantially parallelepipedal in shape. However, while the top end 86 of the carton 5 is generally flat and perpendicular to the side panels 30, 70 and the end panels 10, 50, and the reclosable lid 300 is angled downward relative to the top end 86 when in the closed position 97. Accordingly, when in the closed position 97, the central panel 34 of the reclosable lid 300 is generally oblique with respect to the top flaps 16, 36, 76 of the closed top end 86. Also, according to the illustrated embodiment as shown in FIG. 4, the entire closed top end 86 of the erected carton 5 extends only on a first side of the fold line 69, and the entire reclosable lid 300 extends only on a second side of the fold line 69. In one embodiment, as shown in FIG. 4, the side top flap 36 forms the uppermost surface of the carton 5. Also, as shown in FIG. 4, the side top flap 36 (e.g., the uppermost surface of the carton 5) is a planar surface, and the fold lines 69 and 77 are coplanar with the side top flap 36.

As shown in FIG. 5, the reclosable lid 300 is positionable between the closed position 97 (FIG. 4) and an open position 99 that allows access to the bag B and products held therein. The reclosable lid 300 can be pivoted upwardly about the fold line 69 to position the reclosable lid in the open position 99. Once some or all of the products have been removed from the bag B, the reclosable lid 300 can be returned to the closed position 97 (FIG. 4). Since the top end closing tab 56 is folded downwardly at the longitudinal fold line 75 (FIG. 5), the reclosable lid 300 can easily slide over the top end closing tab 56, which can be tightly squeezed between the second end panel 50 and the third lid flap 40 and closure tabs 42, 44 in the closed position 97. In one embodiment, the top end closing tab 56 can help retain the reclosable lid 300 in the closed position 97. For example, friction between the reclosable lid 300 and the top end closing tab 56, which is disposed between the second end panel 50 and the third lid flap 40, can resist opening of the reclosable lid 300. Alternatively, or in addition, the reclosable lid 300 can be retained in the closed position by a resealable adhesive connection between the reclosable lid and the top end locking tab 56, or the tab and the lid can have other latching features. The products may include, for example, dispensable foodstuffs, or other nonfood products such as detergent, powders, etc.

The reclosable lid 300 formed from the central panel 34, lid flaps 32, 33, 40, and closure tabs 42, 44 allows the blank 3 and carton 5 to be made from a reduced amount of material (e.g., paperboard). The reclosable lid 300 could be otherwise shaped, arranged, and/or configured without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of forming a carton, the method comprising:

obtaining a blank comprising a plurality of panels comprising a first end panel, a first side panel, a second end panel, and a second side panel, at least one top flap respectively foldably connected to a respective panel of the plurality of panels, and lid features comprising a central panel, the central panel being foldably connected to the at least one top flap, wherein the first side panel comprises a first oblique edge and the second side panel comprises a second oblique edge;

forming an interior of the carton at least partially defined by the plurality of panels, the forming the interior of the carton comprising forming an open-ended sleeve;

positioning the at least one top flap to at least partially close a top end of the open-ended sleeve;

positioning the lid features to form a reclosable lid; and positioning the reclosable lid to a closed position wherein the reclosable lid is downwardly folded relative to the at least one top flap, wherein the positioning the reclosable lid to the closed position comprises positioning the central panel of the reclosable lid to be oblique with respect to the at least one top flap and contacting the central panel with the first oblique edge and the second oblique edge.

2. The method of claim 1, wherein the forming the interior of the carton comprises forming a front top portion of the carton, and the positioning the reclosable lid to the closed position comprises closing the front top portion.

3. The method of claim 1, wherein:

the reclosable lid comprises a first lid flap, a second lid flap, and a third lid flap, each of the first lid flap, the second lid flap, and the third lid flap being respectively foldably connected to the central panel; and the positioning the lid features comprises folding the first lid flap, the second lid flap, and the third lid flap downwardly with respect to the central panel so that, in the closed position of the reclosable lid, the first lid flap at least partially overlaps the first side panel, the second lid flap at least partially overlaps the second side panel, and the third lid flap at least partially overlaps the second end panel.

4. The method of claim 3, wherein the at least one top flap comprises at least one side top flap foldably connected to at least one of the first side panel and the second side panel, the positioning the at least one top flap comprising folding the at least one side top flap relative to the first side panel or the second side panel to at least partially close the top end.

5. A method of forming a carton, the method comprising:

obtaining a blank comprising a plurality of panels comprising a first end panel, a first side panel, a second end panel, and a second side panel, at least one top flap respectively foldably connected to a respective panel of the plurality of panels, and lid features comprising a central panel, a first lid flap, a second lid flap, and a third lid flap, each of the first lid flap, the second lid flap, and the third lid flap being respectively foldably connected to the central panel, the central panel being foldably connected to the at least one top flap, wherein the at least one top flap comprises at least one side top flap foldably connected to at least one of the first side panel and the second side panel;

forming an interior of the carton at least partially defined by the plurality of panels, the forming the interior of the carton comprising forming an open-ended sleeve;

positioning the at least one top flap to at least partially close a top end of the open-ended sleeve, the positioning the at least one top flap comprising folding the at least one side top flap relative to the first side panel or the second side panel to at least partially close the top end;

positioning the lid features to form a reclosable lid; and positioning the reclosable lid to a closed position wherein the reclosable lid is downwardly folded relative to the at least one top flap, wherein the central panel of the reclosable lid is foldably connected to the at least one side top flap along a lateral fold line, the positioning the reclosable lid to the closed position comprising folding the central panel downwardly along the lateral fold line to be oblique with respect to the at least one side top flap;

wherein the positioning the lid features comprises folding the first lid flap, the second lid flap, and the third lid flap downwardly with respect to the central panel so that, in the closed position of the reclosable lid, the first lid flap at least partially overlaps the first side panel, the second lid flap at least partially overlaps the second side panel, and the third lid flap at least partially overlaps the second end panel.

6. The method of claim 5, further comprising positioning the reclosable lid to an open position by folding the reclosable lid upwardly along the lateral fold line relative to the at least one side top flap.

7. The method of claim 3, wherein the reclosable lid comprises a first closure tab foldably connected to the first lid flap and a second closure tab foldably connected to the second lid flap, the positioning the lid features comprises securing the first closure tab and the second closure tab to an interior surface of the third lid flap.

8. The method of claim 3, further comprising a locking flap foldably connected to the second end panel, the positioning the reclosable lid to the closed position comprises at least partially engaging the locking flap and the reclosable lid.

9. The method of claim 1, wherein the at least one top flap comprises at least a first side top flap foldably connected to the first side panel along a first fold line, the central panel being foldably connected to the first side top flap along a second fold line.

* * * * *